US011033119B1

(12) United States Patent
Rothermel

(10) Patent No.: US 11,033,119 B1
(45) Date of Patent: Jun. 15, 2021

(54) HOLIDAY CANDY TREE

(71) Applicant: David Rothermel, Greenville, SC (US)

(72) Inventor: David Rothermel, Greenville, SC (US)

( * ) Notice: Subject to any disclaimer, the term of this patent is extended or adjusted under 35 U.S.C. 154(b) by 115 days.

(21) Appl. No.: 16/545,053

(22) Filed: Aug. 20, 2019

(51) Int. Cl.

| | |
|---|---|
| ***A47F 5/04*** | (2006.01) |
| ***A47F 7/00*** | (2006.01) |
| *A47G 33/06* | (2006.01) |
| *B65D 85/60* | (2006.01) |
| *B44C 5/06* | (2006.01) |

(52) U.S. Cl.
CPC ..... *A47F 5/04* (2013.01); *A47F 7/0071* (2013.01); *A47G 33/06* (2013.01); *B44C 5/06* (2013.01); *B65D 85/60* (2013.01)

(58) Field of Classification Search
CPC ..... A47F 5/04; A47F 7/0071; A47F 7/0028; A47F 5/05; A47F 5/0087; A47F 5/0037; A47F 5/06; A47F 5/02; A47G 33/06; A47G 2400/06; A47B 2063/005; A47B 75/00; B44C 5/06; B65D 85/60
USPC ..... 211/163, 85.4, 133.4, 196, 205; 108/93, 108/94, 103, 183; 248/521, 349.1, 415
See application file for complete search history.

(56) References Cited

U.S. PATENT DOCUMENTS 354,509 A 12/1886 Grimm
590,579 A * 9/1897 Keating ..... A47B 13/16 108/26
723,114 A * 3/1903 Witt ..... A47F 5/04 211/205
896,990 A * 8/1908 Hill ..... F16M 11/00 248/125.3
1,570,651 A * 1/1926 Topping ..... A47F 5/04 108/94
1,576,716 A * 3/1926 Casgrain ..... A43D 111/006 12/1 A
2,157,400 A * 5/1939 Morris ..... A47F 5/04 108/96
2,218,329 A * 10/1940 Dunberg ..... A47F 5/04 211/13.1
D128,639 S * 8/1941 Nietsche ..... D11/118
2,692,689 A * 10/1954 Wynne, Sr. ..... A47F 5/04 211/165
2,851,807 A * 9/1958 Taylor ..... A47G 33/06 428/19
2,865,122 A * 12/1958 Clawson ..... A47F 5/02 428/19
3,101,849 A * 8/1963 Osborn ..... A47F 5/06 211/166

(Continued)

*Primary Examiner* — Jonathan Liu
*Assistant Examiner* — Devin K Barnett
(74) *Attorney, Agent, or Firm* — Kyle A. Fletcher, Esq.

(57) ABSTRACT

The holiday candy tree is a decorative item. The holiday candy tree is a figurine. The holiday candy tree forms an image that presents an indicia representing the sentiment of a Christmas tree. The holiday candy tree is formed with a plurality of pans in which a foodstuff is distributed. This disclosure assumes that the foodstuff is candy. The holiday candy tree comprises a plurality of plates, a plurality of spacers, a pedestal, and a stanchion. The stanchion interconnects the plurality of plates, the plurality of spacers, and the pedestal. The plurality of spacers separate the plurality of plates such that the plurality of plates from an image that presents an indicia representing the sentiment of the limbs of the Christmas tree. The plurality of pans are formed in the plurality of plates.

8 Claims, 5 Drawing Sheets

(56) References Cited

U.S. PATENT DOCUMENTS 3,169,496 A * 2/1965 Muggli ..... A47G 23/08 108/94
3,198,338 A * 8/1965 McCormick ..... A47F 5/06 211/14
3,244,870 A * 4/1966 Gallant ..... A47G 33/06 362/235
3,498,471 A * 3/1970 Dirkx et al. ..... B65D 21/0209 211/131.1
3,524,554 A * 8/1970 Ruhnke ..... A47F 5/14 211/163
3,648,892 A * 3/1972 Morgan ..... A47F 5/04 221/301
3,674,612 A * 7/1972 Gehl ..... A47G 33/06 428/7
D231,838 S * 6/1974 Kors ..... D11/130
3,951,079 A * 4/1976 Tolleson ..... A47F 5/02 108/94
4,026,417 A * 5/1977 Streim ..... A47F 5/02 211/163
D250,372 S * 11/1978 Szabo ..... D6/681.3
4,315,376 A 2/1982 Eichenauer
4,333,974 A 6/1982 Davis
D269,771 S * 7/1983 Williams ..... D11/118
4,901,846 A * 2/1990 Lehman ..... B44D 3/04 206/1.8
D317,732 S * 6/1991 Vernon ..... D11/117
5,342,661 A 8/1994 Wilcox
5,458,243 A * 10/1995 McBride ..... A47B 57/30 206/503
5,517,390 A * 5/1996 Zins ..... A47G 33/06 362/123
5,677,018 A 10/1997 Shin
5,984,114 A * 11/1999 Frankel ..... A47F 7/08 211/131.1
6,273,584 B1 * 8/2001 Wang ..... A47G 33/06 362/123
6,350,499 B1 * 2/2002 Babcock ..... A47G 33/06 428/18
6,425,647 B1 * 7/2002 Pothin ..... A47F 5/02 312/135
D494,731 S 8/2004 Jackson
7,144,610 B1 * 12/2006 Estes ..... A47B 97/00 428/19
7,490,950 B1 * 2/2009 Meyers ..... A47G 33/06 362/123
7,922,013 B2 * 4/2011 Nguy ..... B25H 3/04 211/70.6
8,186,524 B2 * 5/2012 Siahpush ..... A47F 5/02 211/196
8,474,616 B2 7/2013 Farid
8,985,351 B1 * 3/2015 Longo ..... A47F 3/0404 211/163
9,333,926 B1 * 5/2016 Henning ..... B60R 11/06
9,364,087 B1 * 6/2016 Sharperson ..... A47B 9/14
D836,719 S * 12/2018 Smith ..... D19/85
10,213,041 B1 * 2/2019 Fonseca ..... F21S 6/004
10,694,844 B1 * 6/2020 Smed ..... A47F 5/04
2003/0000903 A1 * 1/2003 Mondragon ..... A47F 5/02 211/144
2003/0015486 A1 * 1/2003 Chen ..... A47F 5/02 211/70
2003/0029768 A1 * 2/2003 Wong ..... A47F 5/02 206/526
2003/0192840 A1 * 10/2003 Hoyle ..... A47F 5/05 211/85.2
2005/0019451 A1 1/2005 Margiotta
2006/0065613 A1 * 3/2006 McKay ..... A47F 7/02 211/85.2
2008/0061016 A1 * 3/2008 Nicolopulos ..... A47F 5/05 211/62
2008/0061020 A1 * 3/2008 Kaisler ..... A47B 31/02 211/196
2009/0230069 A1 * 9/2009 Naden ..... A47B 96/025 211/144
2011/0005109 A1 1/2011 Junkins
2011/0076425 A1 * 3/2011 Cheng ..... A47G 33/06 428/8
2011/0089128 A1 * 4/2011 Jin ..... A01N 1/0242 211/163
2011/0100940 A1 * 5/2011 Liao ..... A47B 87/0246 211/133.1
2011/0220599 A1 * 9/2011 Siahpush ..... A47G 23/0616 211/85.4
2012/0031860 A1 * 2/2012 Goode ..... A47G 19/00 211/41.2
2012/0219685 A1 * 8/2012 Radow ..... A47G 19/22 426/420
2013/0136829 A1 * 5/2013 Kandel ..... A47G 19/00 426/132
2013/0168342 A1 * 7/2013 Yatscoff ..... A47F 5/04 211/85.2
2013/0313213 A1 * 11/2013 Ellison ..... A47B 87/0223 211/144
2014/0339185 A1 * 11/2014 Ellison ..... A47B 87/0215 211/119.003
2015/0216346 A1 * 8/2015 Taylor ..... A47G 33/06 428/7
2016/0215971 A1 * 7/2016 Silver ..... A47G 33/00
2016/0367026 A1 * 12/2016 Hall ..... A47J 47/16
2017/0014016 A1 * 1/2017 Chan ..... A47F 5/04
2018/0014416 A1 * 1/2018 An ..... G06F 3/147
2019/0110625 A1 * 4/2019 Hale ..... F21V 23/06
2020/0216301 A1 * 7/2020 Plourde ..... F16N 33/00

* cited by examiner

HOLIDAY CANDY TREE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including special furniture, more specifically, a show stand adapted for particular articles including perishable goods.

SUMMARY OF INVENTION

The holiday candy tree is a decorative item. The holiday candy tree is a figurine. The holiday candy tree forms an image that presents an indicia representing the sentiment of a Christmas tree. The holiday candy tree is formed with a plurality of pans in which a foodstuff is distributed. This disclosure assumes that the foodstuff is candy. The holiday candy tree comprises a plurality of plates, a plurality of spacers, a pedestal, and a stanchion. The stanchion interconnects the plurality of plates, the plurality of spacers, and the pedestal. The plurality of spacers separate the plurality of plates such that the plurality of plates from an image that presents an indicia representing the sentiment of the limbs of the Christmas tree. The plurality of pans are formed in the plurality of plates.

These together with additional objects, features and advantages of the holiday candy tree will be readily apparent to those of ordinary skill in the art upon reading the following detailed description of the presently preferred, but nonetheless illustrative, embodiments when taken in conjunction with the accompanying drawings.

In this respect, before explaining the current embodiments of the holiday candy tree in detail, it is to be understood that the holiday candy tree is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the holiday candy tree.

It is therefore important that the claims be regarded as including such equivalent construction insofar as they do not depart from the spirit and scope of the holiday candy tree. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
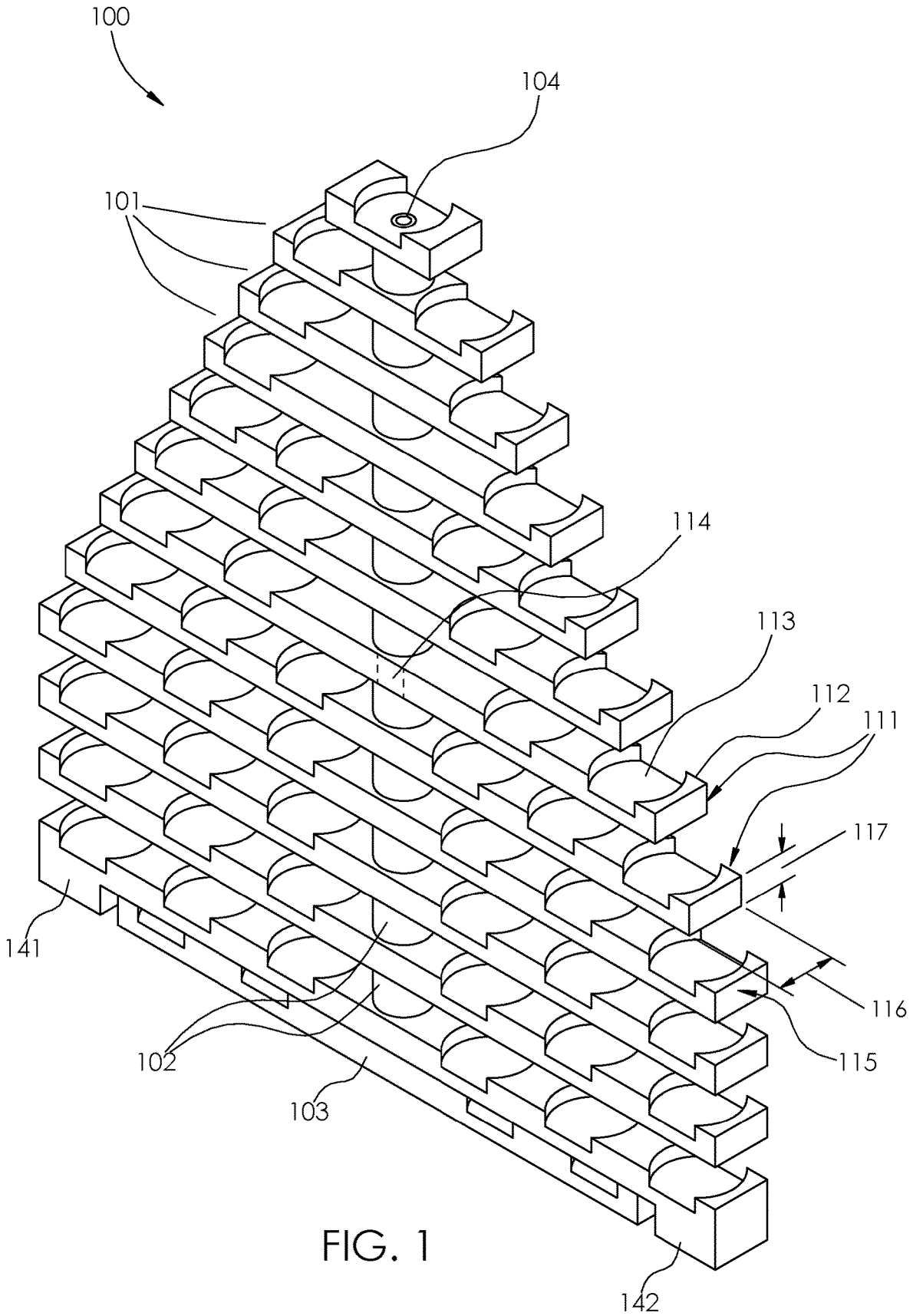
FIG. 1 is a perspective view of an embodiment of the disclosure.
Figure 2:
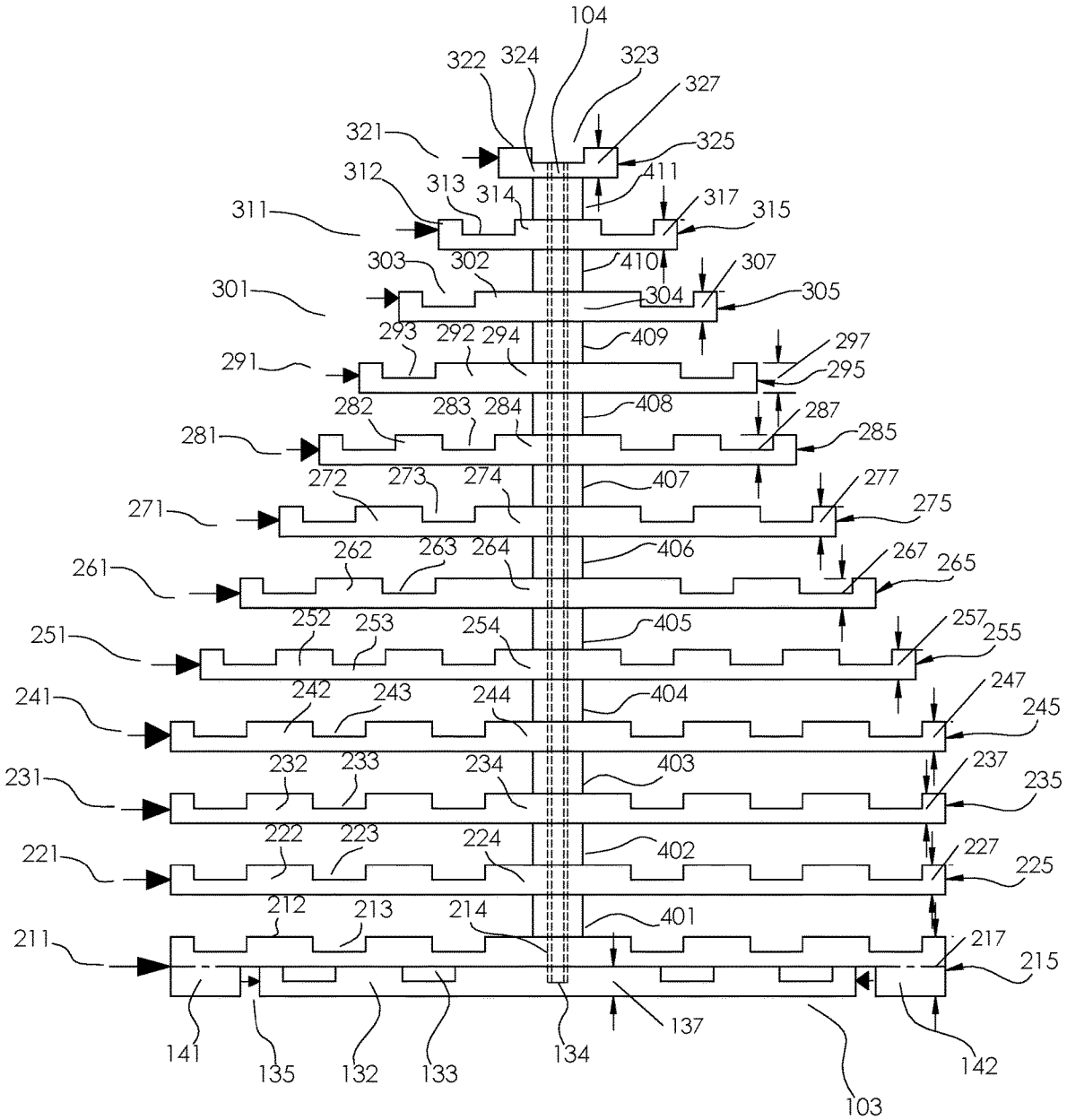
FIG. 2 is a front view of an embodiment of the disclosure.
Figure 3:
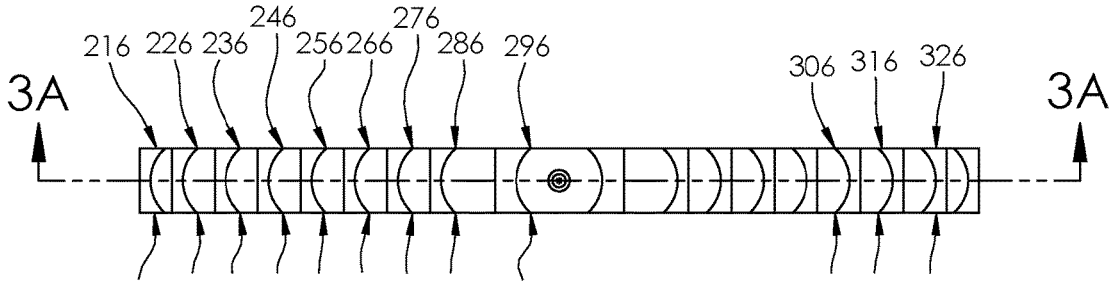
FIG. 3 is a top view of an embodiment of the disclosure.
Figure 3A:
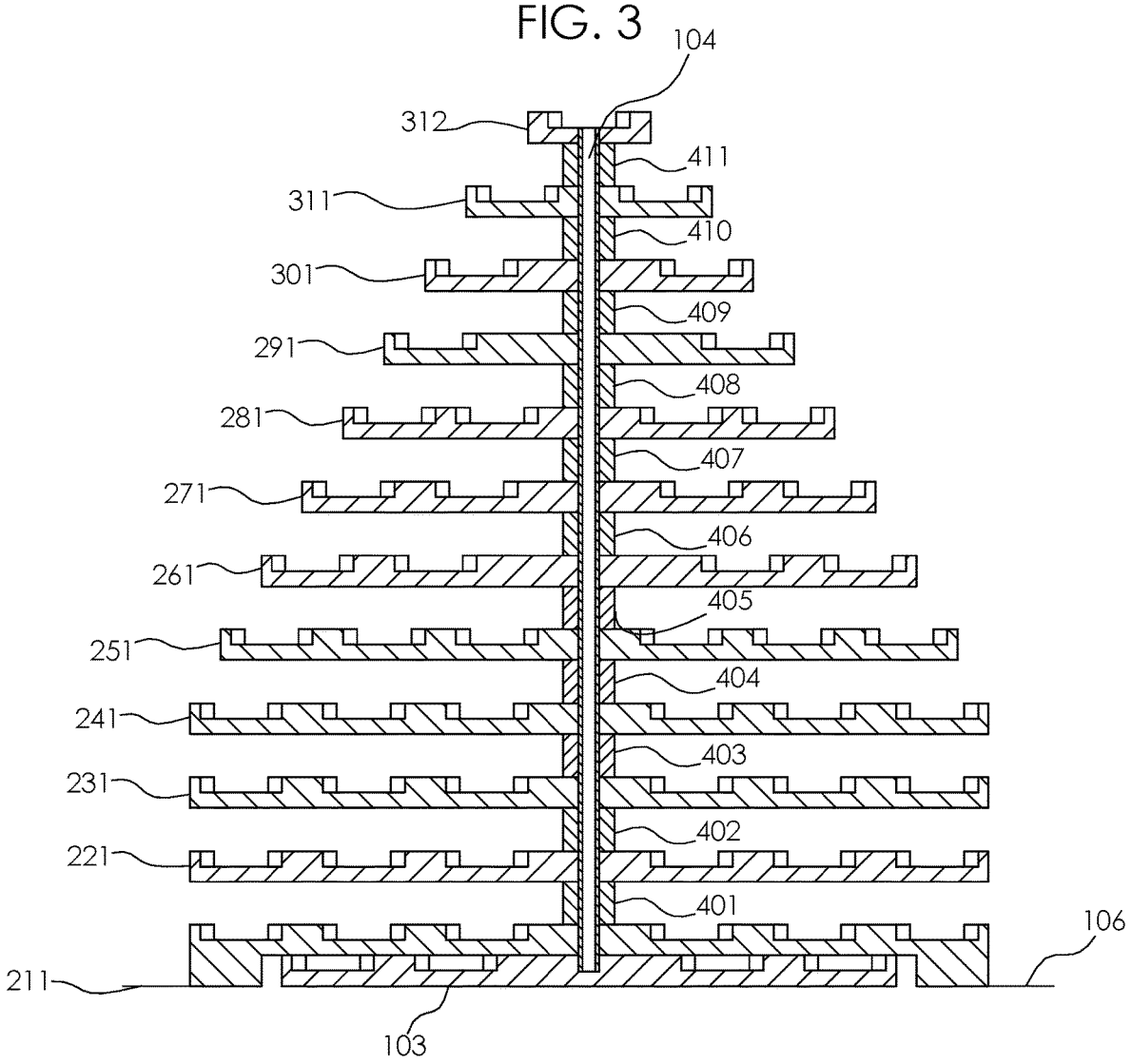
FIG. 3A is a cross-sectional view of an embodiment of the disclosure across 3A-3A as shown in FIG. 3.
Figure 4:
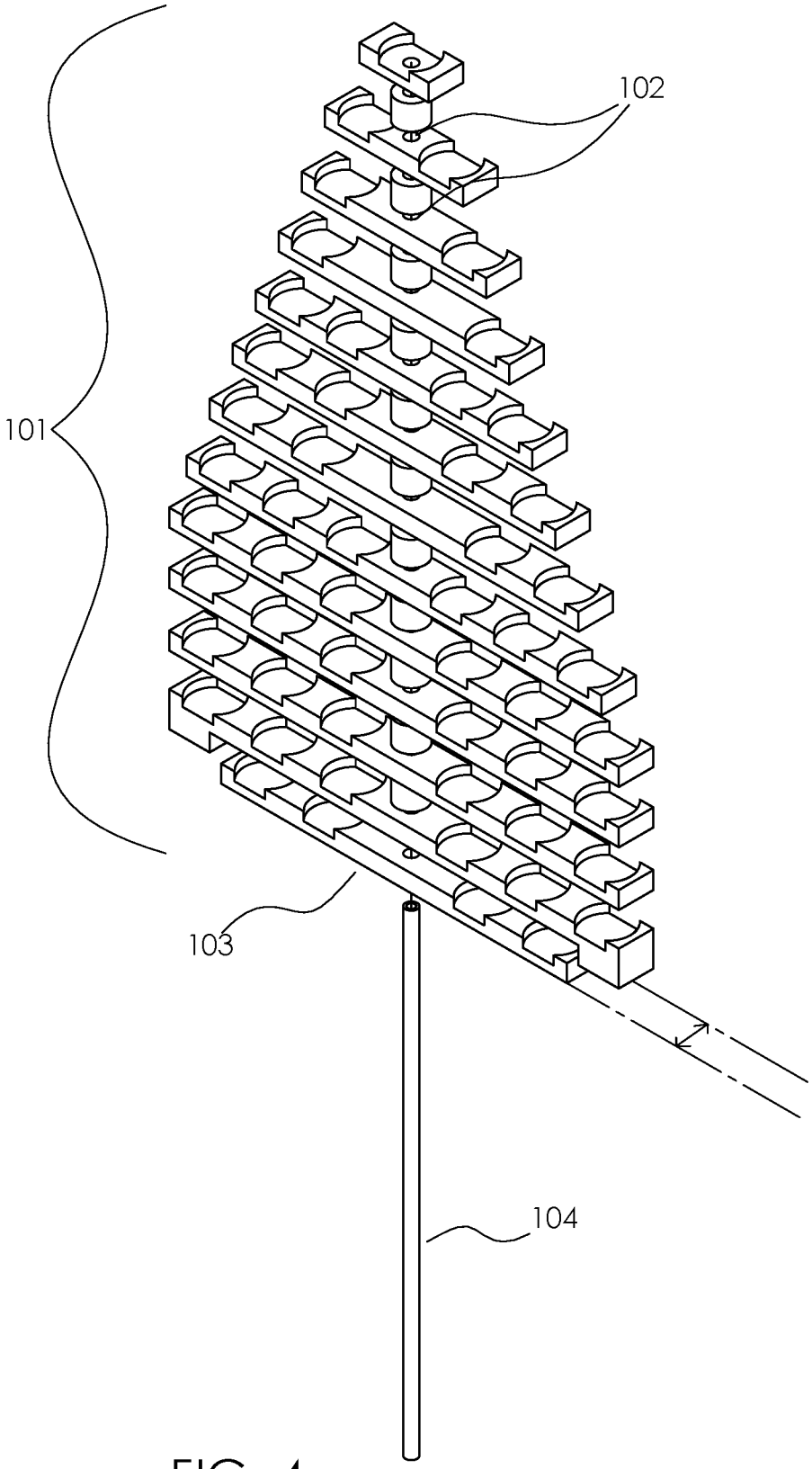
FIG. 4 is an exploded view of an embodiment of the disclosure.
Figure 5:
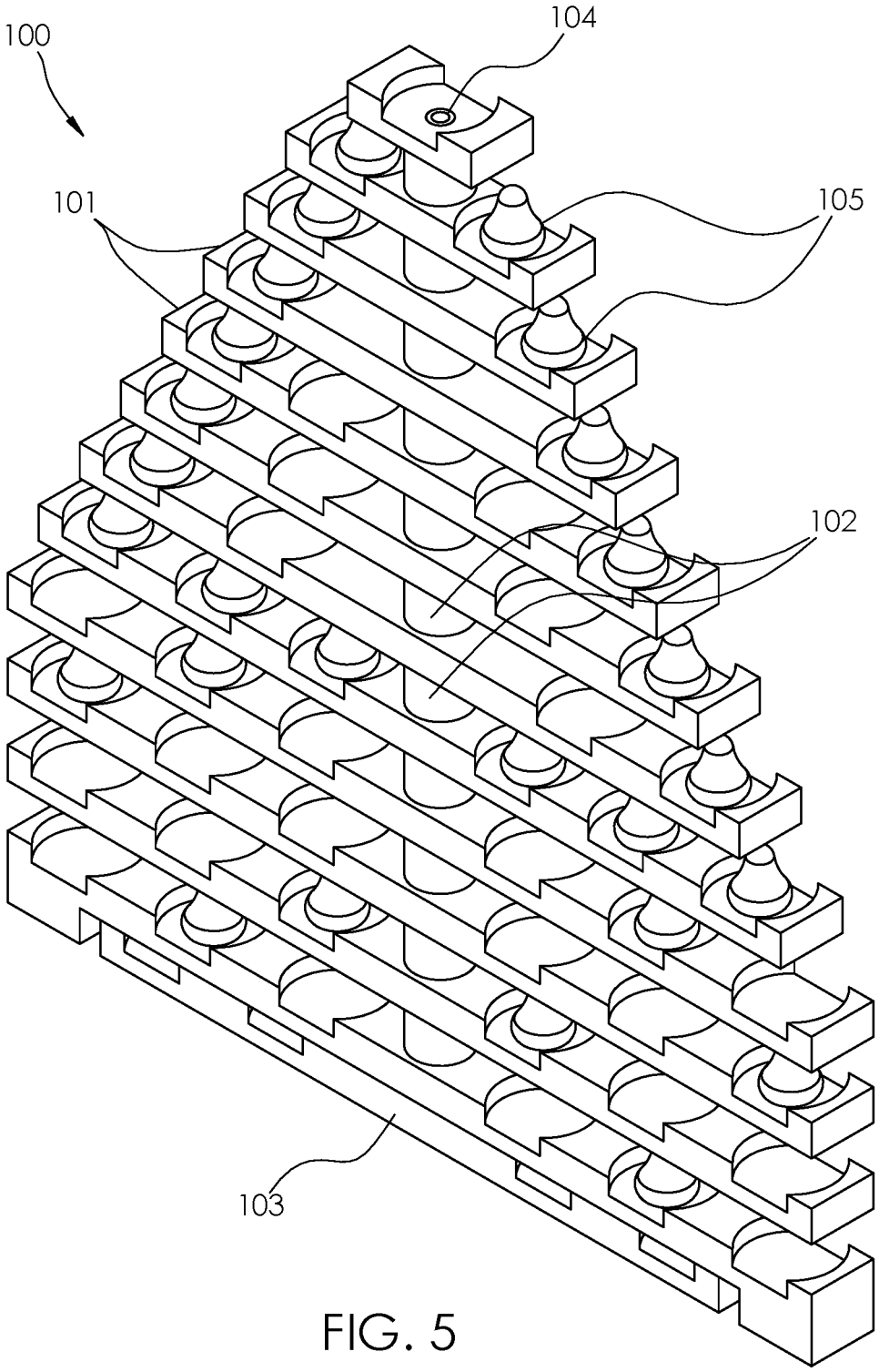
FIG. 5 is an in-use view of an embodiment of the disclosure.

Detailed reference will now be made to one or more potential embodiments of the disclosure, which are illustrated in FIGS. 1 through 5.

The holiday candy tree 100 (hereinafter invention) is a decorative item. The invention 100 is a figurine. The invention 100 forms an image that presents an indicia representing the sentiment of a Christmas tree. The invention 100 is formed with a plurality of pans in which a foodstuff 105 is distributed. This disclosure assumes that the foodstuff 105 is candy. The invention 100 comprises a plurality of plates 101, a plurality of spacers 102, a pedestal 103, and a stanchion 104. The stanchion 104 interconnects the plurality of plates 101, the plurality of spacers 102, and the pedestal 103. The plurality of spacers 102 separate the plurality of plates 101 such that the plurality of plates 101 from an image that presents an indicia representing the sentiment of the limbs of the Christmas tree. The plurality of pans are formed in the plurality of plates 101. The foodstuff 105 is defined elsewhere in this disclosure. The supporting surface 106 is defined elsewhere in this disclosure.

Each of the plurality of plates 101 is a disk-shaped structure. The faces of the disk structure of each of the plurality of plates 101 are horizontally oriented. In the first potential embodiment of the disclosure, each of the plurality of plates 101 has a rectangular block structure. The plurality of plates 101 comprises a collection of individual plates 111.

Each individual plate 111 is a plate selected from the plurality of plates 101. Each individual plate 111 forms a horizontal supporting surface on which the foodstuff 105 is stored. The individual plate 111 comprises a base disk 112, an individual set of one or more pans 113, and an individual nut 114. The individual plate 111 is further defined with an individual span of length 115, an individual span of width 116, and an individual span of depth 117.

The base disk 112 is a disk-shaped structure. The faces of the disk structure of the base disk 112 are horizontally oriented. In the first potential embodiment of the disclosure, the base disk 112 has a rectangular block structure that forms the primary shape of the individual plate 111.

The individual set of one or more pans 113 comprises a collection of cavities. The individual set of one or more pans 113 is formed in the superior face of the disk structure of the base disk 112. Each pan selected from the individual set of one or more pans 113 is a disk-shaped negative space. Each pan selected from the individual set of one or more pans 113 has the shape of a semi-enclosed pan. The foodstuff 105 is stored in one or more pans selected from the individual set of one or more pans 113. The semi-enclosed structure of each pan selected from the individual set of one or more pans 113 allows a foodstuff 105 to be removed from the selected pan through the lateral face of the disk structure of the individual plate 111.

The individual nut 114 is a nut formed between the faces of the disk structure of the base disk 112. The individual nut 114 is a prism-shaped negative space. The center axis of the individual nut 114 passes through the center of the base disk 112. The center axis of the individual nut 114 is perpendicular to the faces of the disk structure of the base disk 112.

The individual span of depth 117 is the span of the distance of the base disk 112 in the direction of a perpendicular line between the faces of the disk structure of the base disk 112. The individual span of length 115 is the span of the distance of the base disk 112 in the direction of the base disk 112 that is parallel to the edge of the base disk 112 with the greatest span of distance. The individual span of width 116 is the span of the distance of the base disk 112 that is simultaneously perpendicular to both the individual span of length 115 and the individual span of depth 117.

Each of the plurality of spacers 102 has a nut structure. Each of the plurality of spacers 102 is an extension structure that separates an initial plate selected from the plurality of plates 101 to a subsequent plate selected from the plurality of plates 101. Each of the plurality of spacers 102 is identical. The span of the inner diameter of each of the plurality of spacers 102 is greater than the span of the outer diameter of the stanchion 104 such that the stanchion 104 can insert through any spacer selected from the plurality of spacers 102.

In the first potential embodiment of the disclosure, the plurality of spacers 102 comprises a first spacer 401, a second spacer 402, a third spacer 403, a fourth spacer 404, a fifth spacer 405, a sixth spacer 406, a seventh spacer 407, an eighth spacer 408, a ninth spacer 409, a tenth spacer 410, and an eleventh spacer 411.

The pedestal 103 is a disk-shaped structure. The pedestal 103 are horizontally oriented. The pedestal 103 rests on the supporting surface 106. The pedestal 103 forms the final link of the load path of the stanchion 104 and any loads borne by the stanchion 104 to the supporting surface 106. The structure of the pedestal 103 is similar to the structure of any individual plate 111 selected from the plurality of plates 101.

Specifically, the pedestal 103 comprises a pedestal disk 132, a one or more pedestal pans 133, and a pedestal nut 134. The pedestal 103 is further defined with a pedestal span of length 135, a pedestal span of width 136, and a pedestal span of depth 137.

The pedestal disk 132 forms the base disk 112 for the pedestal 103. The one or more pedestal pans 133 forms the individual set of one or more pans 113 for the pedestal 103. The pedestal nut 134 forms the individual nut 114 for the pedestal 103. The pedestal span of length 135 is the individual span of length 115 for the pedestal 103. The pedestal span of width 136 is the individual span of width 116 for the pedestal 103. The pedestal span of depth 137 is the individual span of depth 117 for the pedestal 103.

The stanchion 104 is a vertically oriented prism-shaped shaft. The plurality of plates 101, the plurality of spacers 102, and the pedestal 103 attach to the stanchion 104 to form the invention 100. The stanchion 104 stabilizes the invention 100. The stanchion 104 is selected from the group consisting of a tubular structure and a solid prism structure. The stanchion 104 has a lateral face structure selected from the group consisting of: a) a smooth exterior lateral face and no interior lateral face; b) a smooth exterior lateral face and a smooth lateral face; c) an exterior lateral face with an exterior screw thread and no interior lateral face; d) an exterior lateral face with an exterior screw thread and a smooth interior lateral face; e) an exterior lateral face with an exterior screw thread and an interior lateral face with an interior screw thread; and, f) a smooth exterior lateral face and an interior lateral face with an interior screw thread.

The balance of this disclosure describes the first potential embodiment of the disclosure.

In the first potential embodiment of the disclosure, the plurality of plates 101 comprises a first plate 211, a second plate 221, a third plate 231, a fourth plate 241, a fifth plate 251, a sixth plate 261, a seventh plate 271, an eighth plate 281, a ninth plate 291, a tenth plate 301, an eleventh plate 311 and a twelfth plate 321.

The first plate 211 comprises a first base disk 212, a first one or more pans 213, a first nut 214, a first riser 141, and a second riser 142. The first plate 211 is further defined with a first span of length 215, a first span of width 216, and a first span of depth 217. The first base disk 212 forms the base disk 112 for the first plate 211. The first one or more pans 213 forms the individual set of one or more pans 113 for the first plate 211. The first nut 214 forms the individual nut 114 for the first plate 211. The first span of length 215 is the individual span of length 115 as measured on the first plate 211. The first span of width 216 is the individual span of width 116 as measured on the first plate 211. The first span of depth 217 is the individual span of depth 117 as measured on the first plate 211.

The first riser 141 is a rectangular block structure formed on the inferior face of the disk structure of the first plate 211 selected from the plurality of plates 101. The first riser 141 forms a structure that elevates the first plate 211 above the supporting surface 106. The second riser 142 is a rectangular block structure formed on the inferior face of the disk structure of the first plate 211 selected from the plurality of plates 101. The second riser 142 forms a structure that elevates the first plate 211 above the supporting surface 106. The first riser 141 and the second riser 142 are identical. The pedestal span of length 135 of the pedestal 103 fits between the first riser 141 and the second riser 142.

The second plate 221 comprises a second base disk 222, a second one or more pans 223, and a second nut 224. The second plate 221 is further defined with a second span of length 225, a second span of width 226, and a second span of depth 227. The second base disk 222 forms the base disk 112 for the second plate 221. The second one or more pans 223 forms the individual set of one or more pans 113 for the second plate 221. The second nut 224 forms the individual nut 114 for the second plate 221. The second span of length 225 is the individual span of length 115 as measured on the second plate 221. The second span of width 226 is the individual span of width 116 as measured on the second plate 221. The second span of depth 227 is the individual span of depth 117 as measured on the second plate 221.

The third plate 231 comprises a third base disk 232, a third one or more pans 233, and a third nut 234. The third plate 231 is further defined with a third span of length 235, a third span of width 236, and a third span of depth 237. The third base disk 232 forms the base disk 112 for the third plate 231. The third one or more pans 233 forms the individual set of one or more pans 113 for the third plate 231. The third nut 234 forms the individual nut 114 for the third plate 231. The third span of length 235 is the individual span of length 115 as measured on the third plate 231. The third span of width 236 is the individual span of width 116 as measured on the third plate 231. The third span of depth 237 is the individual span of depth 117 as measured on the third plate 231.

The fourth plate 241 comprises a fourth base disk 242, a fourth one or more pans 243, and a fourth nut 244. The fourth plate 241 is further defined with a fourth span of length 245, a fourth span of width 246, and a fourth span of depth 247. The fourth base disk 242 forms the base disk 112 for the fourth plate 241. The fourth one or more pans 243 forms the individual set of one or more pans 113 for the fourth plate 241. The fourth nut 244 forms the individual nut 114 for the fourth plate 241. The fourth span of length 245 is the individual span of length 115 as measured on the fourth plate 241. The fourth span of width 246 is the individual span of width 116 as measured on the fourth plate 241. The fourth span of depth 247 is the individual span of depth 117 as measured on the fourth plate 241.

The fifth plate 251 comprises a fifth base disk 252, a fifth one or more pans 253, and a fifth nut 254. The fifth plate 251 is further defined with a fifth span of length 255, a fifth span of width 256, and a fifth span of depth 257. The fifth base disk 252 forms the base disk 112 for the fifth plate 251. The fifth one or more pans 253 forms the individual set of one or more pans 113 for the fifth plate 251. The fifth nut 254 forms the individual nut 114 for the fifth plate 251. The fifth span of length 255 is the individual span of length 115 as measured on the fifth plate 251. The fifth span of width 256 is the individual span of width 116 as measured on the fifth plate 251. The fifth span of depth 257 is the individual span of depth 117 as measured on the fifth plate 251.

The sixth plate 261 comprises a sixth base disk 262, a sixth one or more pans 263, and a sixth nut 264. The sixth plate 261 is further defined with a sixth span of length 265, a sixth span of width 266, and a sixth span of depth 267. The sixth base disk 262 forms the base disk 112 for the sixth plate 261. The sixth one or more pans 263 forms the individual set of one or more pans 113 for the sixth plate 261. The sixth nut 264 forms the individual nut 114 for the sixth plate 261. The sixth span of length 265 is the individual span of length 115 as measured on the sixth plate 261. The sixth span of width 266 is the individual span of width 116 as measured on the sixth plate 261. The sixth span of depth 267 is the individual span of depth 117 as measured on the sixth plate 261.

The seventh plate 271 comprises a seventh base disk 272, a seventh one or more pans 273, and a seventh nut 274. The seventh plate 271 is further defined with a seventh span of length 275, a seventh span of width 276, and a seventh span of depth 277. The seventh base disk 272 forms the base disk 112 for the seventh plate 271. The seventh one or more pans 273 forms the individual set of one or more pans 113 for the seventh plate 271. The seventh nut 274 forms the individual nut 114 for the seventh plate 271. The seventh span of length 275 is the individual span of length 115 as measured on the seventh plate 271. The seventh span of width 276 is the individual span of width 116 as measured on the seventh plate 271. The seventh span of depth 277 is the individual span of depth 117 as measured on the seventh plate 271.

The eighth plate 281 comprises an eighth base disk 282, an eighth one or more pans 283, and an eighth nut 284. The eighth plate 281 is further defined with an eighth span of length 285, an eighth span of width 286, and an eighth span of depth 287. The eighth base disk 282 forms the base disk 112 for the eighth plate 281. The eighth one or more pans 283 forms the individual set of one or more pans 113 for the eighth plate 281. The eighth nut 284 forms the individual nut 114 for the eighth plate 281. The eighth span of length 285 is the individual span of length 115 as measured on the eighth plate 281. The eighth span of width 286 is the individual span of width 116 as measured on the eighth plate 281. The eighth span of depth 287 is the individual span of depth 117 as measured on the eighth plate 281.

The ninth plate 291 comprises a ninth base disk 292, a ninth one or more pans 293, and a ninth nut 294. The ninth plate 291 is further defined with a ninth span of length 295, a ninth span of width 296, and a ninth span of depth 297. The ninth base disk 292 forms the base disk 112 for the ninth plate 291. The ninth one or more pans 293 forms the individual set of one or more pans 113 for the ninth plate 291. The ninth nut 294 forms the individual nut 114 for the ninth plate 291. The ninth span of length 295 is the individual span of length 115 as measured on the ninth plate 291. The ninth span of width 296 is the individual span of width 116 as measured on the ninth plate 291. The ninth span of depth 297 is the individual span of depth 117 as measured on the ninth plate 291.

The tenth plate 301 comprises a tenth base disk 302, a tenth one or more pans 303, and a tenth nut 304. The tenth plate 301 is further defined with a tenth span of length 305, a tenth span of width 306, and a tenth span of depth 307. The tenth base disk 302 forms the base disk 112 for the tenth plate 301. The tenth one or more pans 303 forms the individual set of one or more pans 113 for the tenth plate 301. The tenth nut 304 forms the individual nut 114 for the tenth plate 301. The tenth span of length 305 is the individual span of length 115 as measured on the tenth plate 301. The tenth span of width 306 is the individual span of width 116 as measured on the tenth plate 301. The tenth span of depth 307 is the individual span of depth 117 as measured on the tenth plate 301.

The eleventh plate 311 comprises an eleventh base disk 312, an eleventh one or more pans 313, and an eleventh nut 314. The eleventh plate 311 is further defined with an eleventh span of length 315, an eleventh span of width 316, and an eleventh span of depth 317. The eleventh base disk 312 forms the base disk 112 for the eleventh plate 311. The eleventh one or more pans 313 forms the individual set of one or more pans 113 for the eleventh plate 311. The eleventh nut 314 forms the individual nut 114 for the eleventh plate 311. The eleventh span of length 315 is the individual span of length 115 as measured on the eleventh plate 311. The eleventh span of width 316 is the individual span of width 116 as measured on the eleventh plate 311. The eleventh span of depth 317 is the individual span of depth 117 as measured on the eleventh plate 311.

The twelfth plate 321 comprises a twelfth base disk 322, a twelfth one or more pans 323, and a twelfth nut 324. The twelfth plate 321 is further defined with a twelfth span of length 325, a twelfth span of width 326, and a twelfth span of depth 327. The twelfth base disk 322 forms the base disk 112 for the twelfth plate 321. The twelfth one or more pans 323 forms the individual set of one or more pans 113 for the twelfth plate 321. The twelfth nut 324 forms the individual nut 114 for the twelfth plate 321. The twelfth span of length 325 is the individual span of length 115 as measured on the twelfth plate 321. The twelfth span of width 326 is the individual span of width 116 as measured on the twelfth plate 321. The twelfth span of depth 327 is the individual span of depth 117 as measured on the twelfth plate 321.

The following five paragraphs describe the relative relationships between the plurality of plates 101 and the plurality of spacers.

The position of the first plate 211 is between the pedestal 103 and the second plate 221. The position of the second plate 221 is between the first plate 211 and the third plate 231. The position of the third plate 231 is between the second plate 221 and the fourth plate 241. The position of the fourth plate 241 is between the third plate 231 and the fifth plate 251. The position of the fifth plate 251 is between the fourth plate 241 and the sixth plate 261.

The position of the sixth plate 261 is between the fifth plate 251 and the seventh plate 271. The position of the seventh plate 271 is between the sixth plate 261 and the eighth plate 281. The position of the eighth plate 281 is between the seventh plate 271 and the ninth plate 291. The position of the ninth plate 291 is between the eighth plate 281 and the tenth plate 301. The position of the tenth plate 301 is between the ninth plate 291 and the eleventh plate 311. The position of the eleventh plate 311 is between the tenth plate 301 and the twelfth plate 321. The position of the twelfth plate 321 is above the eleventh plate 311.

The first spacer 401 is a nut that forms a spacer. The first spacer 401 is an extension structure that separates the first plate 211 and the second plate 221. The second spacer 402 is a nut that forms a spacer. The second spacer 402 is an extension structure that separates the second plate 221 and the third plate 231. The third spacer 403 is a nut that forms a spacer. The third spacer 403 is an extension structure that separates the third plate 231 and the fourth plate 241. The fourth spacer 404 is a nut that forms a spacer. The fourth spacer 404 is an extension structure that separates the fourth plate 241 and the fifth plate 251.

The fifth spacer 405 is a nut that forms a spacer. The fifth spacer 405 is an extension structure that separates the fifth plate 251 and the sixth plate 261. The sixth spacer 406 is a nut that forms a spacer. The sixth spacer 406 is an extension structure that separates the sixth plate 261 and the seventh plate 271. The seventh spacer 407 is a nut that forms a spacer. The seventh spacer 407 is an extension structure that separates the seventh plate 271 and the eighth plate 281. The eighth spacer 408 is a nut that forms a spacer. The eighth spacer 408 is an extension structure that separates the eighth plate 281 and the ninth plate 291.

The ninth spacer 409 is a nut that forms a spacer. The ninth spacer 409 is an extension structure that separates the ninth plate 291 and the tenth plate 301. The tenth spacer 410 is a nut that forms a spacer. The tenth spacer 410 is an extension structure that separates the tenth plate 301 and the eleventh plate 311. The eleventh spacer 411 is a nut that forms a spacer. The eleventh spacer 411 is an extension structure that separates the eleventh plate 311 and the twelfth plate 321.

The following twelve paragraphs describe the size relationships between each of the plurality of plates 101.

The span of the length of the pedestal span of length 135 of the pedestal disk 132 is lesser than the span of the length of the first span of length 215 of the first base disk 212. The span of the length of the pedestal span of width 136 of the pedestal disk 132 equals the span of the length of the first span of width 216 of the first base disk 212. The span of the length of the pedestal span of depth 137 of the pedestal disk 132 equals the span of the length of the first span of depth 217 of the first base disk 212.

The span of the length of the first span of length 215 of the first base disk 212 is lesser than the span of the length of the second span of length 225 of the second base disk 222. The span of the length of the first span of width 216 of the first base disk 212 equals the span of the length of the second span of width 226 of the second base disk 222. The span of the length of the first span of depth 217 of the first base disk 212 equals the span of the length of the second span of depth 227 of the second base disk 222.

The span of the length of the second span of length 225 of the second base disk 222 is lesser than the span of the length of the third span of length 235 of the third base disk 232. The span of the length of the second span of width 226 of the second base disk 222 equals the span of the length of the third span of width 236 of the third base disk 232. The span of the length of the second span of depth 227 of the second base disk 222 equals the span of the length of the third span of depth 237 of the third base disk 232.

The span of the length of the third span of length 235 of the third base disk 232 is lesser than the span of the length of the fourth span of length 245 of the fourth base disk 242. The span of the length of the third span of width 236 of the third base disk 232 equals the span of the length of the fourth span of width 246 of the fourth base disk 242. The span of the length of the third span of depth 237 of the third base disk 232 equals the span of the length of the fourth span of depth 247 of the fourth base disk 242.

The span of the length of the fourth span of length 245 of the fourth base disk 242 is lesser than the span of the length of the fifth span of length 255 of the fifth base disk 252. The span of the length of the fourth span of width 246 of the fourth base disk 242 equals the span of the length of the fifth span of width 256 of the fifth base disk 252. The span of the length of the fourth span of depth 247 of the fourth base disk 242 equals the span of the length of the fifth span of depth 257 of the fifth base disk 252.

The span of the length of the fifth span of length 255 of the fifth base disk 252 is lesser than the span of the length of the sixth span of length 265 of the sixth base disk 262. The span of the length of the fifth span of width 256 of the fifth base disk 252 equals the span of the length of the sixth span of width 266 of the sixth base disk 262. The span of the length of the fifth span of depth 257 of the fifth base disk 252 equals the span of the length of the sixth span of depth 267 of the sixth base disk 262.

The span of the length of the sixth span of length 265 of the sixth base disk 262 is lesser than the span of the length of the seventh span of length 275 of the seventh base disk 272. The span of the length of the sixth span of width 266 of the sixth base disk 262 equals the span of the length of the seventh span of width 276 of the seventh base disk 272. The span of the length of the sixth span of depth 267 of the sixth base disk 262 equals the span of the length of the seventh span of depth 277 of the seventh base disk 272.

The span of the length of the seventh span of length 275 of the seventh base disk 272 is lesser than the span of the length of the eighth span of length 285 of the eighth base disk 282. The span of the length of the seventh span of width 276 of the seventh base disk 272 equals the span of the length of the eighth span of width 286 of the eighth base disk 282. The span of the length of the seventh span of depth 277 of the seventh base disk 272 equals the span of the length of the eighth span of depth 287 of the eighth base disk 282.

The span of the length of the eighth span of length 285 of the eighth base disk 282 is lesser than the span of the length of the ninth span of length 295 of the ninth base disk 292. The span of the length of the eighth span of width 286 of the eighth base disk 282 equals the span of the length of the ninth span of width 296 of the ninth base disk 292. The span of the length of the eighth span of depth 287 of the eighth base disk 282 equals the span of the length of the ninth span of depth 297 of the ninth base disk 292.

The span of the length of the ninth span of length 295 of the ninth base disk 292 is lesser than the span of the length of the tenth span of length 305 of the tenth base disk 302. The span of the length of the ninth span of width 296 of the ninth base disk 292 equals the span of the length of the tenth span of width 306 of the tenth base disk 302. The span of the length of the ninth span of depth 297 of the ninth base disk 292 equals the span of the length of the tenth span of depth 307 of the tenth base disk 302.

The span of the length of the tenth span of length 305 of the tenth base disk 302 is lesser than the span of the length of the eleventh span of length 315 of the eleventh base disk 312. The span of the length of the tenth span of width 306 of the tenth base disk 302 equals the span of the length of the eleventh span of width 316 of the eleventh base disk 312. The span of the length of the tenth span of depth 307 of the tenth base disk 302 equals the span of the length of the eleventh span of depth 317 of the eleventh base disk 312.

The span of the length of the eleventh span of length 315 of the eleventh base disk 312 is lesser than the span of the length of the twelfth span of length 325 of the twelfth base disk 322. The span of the length of the eleventh span of width 316 of the eleventh base disk 312 equals the span of the length of the twelfth span of width 326 of the twelfth base disk 322. The span of the length of the eleventh span of depth 317 of the eleventh base disk 312 equals the span of the length of the twelfth span of depth 327 of the twelfth base disk 322.

The following four paragraphs describe the relative pan counts in each of the plurality of plates 101.

The number of pans contained in the first one or more pans 213 of the first plate 211 is greater than or equal to the number of pans contained in the second one or more pans 223 of the second plate 221. The number of pans contained in the second one or more pans 223 of the second plate 221 is greater than or equal to the number of pans contained in the third one or more pans 233 of the third plate 231. The number of pans contained in the third one or more pans 233 of the third plate 231 is greater than or equal to the number of pans contained in the fourth one or more pans 243 of the fourth plate 241.

The number of pans contained in the fourth one or more pans 243 of the fourth plate 241 is greater than or equal to the number of pans contained in the fifth one or more pans 253 of the fifth plate 251. The number of pans contained in the fifth one or more pans 253 of the fifth plate 251 is greater than or equal to the number of pans contained in the sixth one or more pans 263 of the sixth plate 261. The number of pans contained in the sixth one or more pans 263 of the sixth plate 261 is greater than or equal to the number of pans contained in the seventh one or more pans 273 of the seventh plate 271.

The number of pans contained in the seventh one or more pans 273 of the seventh plate 271 is greater than or equal to the number of pans contained in the eighth one or more pans 283 of the eighth plate 281. The number of pans contained in the eighth one or more pans 283 of the eighth plate 281 is greater than or equal to the number of pans contained in the ninth one or more pans 293 of the ninth plate 291. The number of pans contained in the ninth one or more pans 293 of the ninth plate 291 is greater than or equal to the number of pans contained in the tenth one or more pans 303 of the tenth plate 301.

The number of pans contained in the tenth one or more pans 303 of the tenth plate 301 is greater than or equal to the number of pans contained in the eleventh one or more pans 313 of the eleventh plate 311. The number of pans contained in the eleventh one or more pans 313 of the eleventh plate 311 is greater than or equal to the number of pans contained in the twelfth one or more pans 323 of the twelfth plate 321.

The following twelve paragraphs describe the assembly of the invention 100.

The stanchion 104 secures to the pedestal 103 by attaching an end of the stanchion 104 to the pedestal nut 134 of the pedestal 103. The pedestal 103 rests on the supporting surface 106. The stanchion 104 inserts through the first nut 214 of the first plate 211 such that the: a) first riser 141 and the second riser 142 rest on the supporting surface 106; and, b) the first base disk 212, the first riser 141 and the second riser 142 forms a U-shaped structure that enclosed the pedestal 103.

The stanchion 104 inserts through the first spacer 401 such that the inferior end of the first spacer 401 rests on the superior face of the first plate 211. The stanchion 104 inserts through the second nut 224 of the second plate 221 such that the inferior face of the second plate 221 rests on the superior end of the first spacer 401.

The stanchion 104 inserts through the second spacer 402 such that the inferior end of the second spacer 402 rests on the superior face of the second plate 221. The stanchion 104 inserts through the third nut 234 of the third plate 231 such that the inferior face of the third plate 231 rests on the superior end of the second spacer 402.

The stanchion 104 inserts through the third spacer 403 such that the inferior end of the third spacer 403 rests on the superior face of the third plate 231. The stanchion 104 inserts through the fourth nut 244 of the fourth plate 241 such that the inferior face of the fourth plate 241 rests on the superior end of the third spacer 403.

The stanchion 104 inserts through the fourth spacer 404 such that the inferior end of the fourth spacer 404 rests on the superior face of the fourth plate 241. The stanchion 104 inserts through the fifth nut 254 of the fifth plate 251 such that the inferior face of the fifth plate 251 rests on the superior end of the fourth spacer 404.

The stanchion 104 inserts through the fifth spacer 405 such that the inferior end of the fifth spacer 405 rests on the superior face of the fifth plate 251. The stanchion 104 inserts through the sixth nut 264 of the sixth plate 261 such that the inferior face of the sixth plate 261 rests on the superior end of the fifth spacer 405.

The stanchion 104 inserts through the sixth spacer 406 such that the inferior end of the sixth spacer 406 rests on the superior face of the sixth plate 261. The stanchion 104 inserts through the seventh nut 274 of the seventh plate 271 such that the inferior face of the seventh plate 271 rests on the superior end of the sixth spacer 406.

The stanchion 104 inserts through the seventh spacer 407 such that the inferior end of the seventh spacer 407 rests on the superior face of the seventh plate 271. The stanchion 104 inserts through the eighth nut 284 of the eighth plate 281 such that the inferior face of the eighth plate 281 rests on the superior end of the seventh spacer 407.

The stanchion 104 inserts through the eighth spacer 408 such that the inferior end of the eighth spacer 408 rests on the superior face of the eighth plate 281. The stanchion 104 inserts through the ninth nut 294 of the ninth plate 291 such that the inferior face of the ninth plate 291 rests on the superior end of the eighth spacer 408.

The stanchion 104 inserts through the ninth spacer 409 such that the inferior end of the ninth spacer 409 rests on the superior face of the ninth plate 291. The stanchion 104 inserts through the tenth nut 304 of the tenth plate 301 such that the inferior face of the tenth plate 301 rests on the superior end of the ninth spacer 409.

The stanchion 104 inserts through the tenth spacer 410 such that the inferior end of the tenth spacer 410 rests on the superior face of the tenth plate 301. The stanchion 104 inserts through the eleventh nut 314 of the eleventh plate 311 such that the inferior face of the eleventh plate 311 rests on the superior end of the tenth spacer 410.

The stanchion 104 inserts through the eleventh spacer 411 such that the inferior end of the eleventh spacer 411 rests on the superior face of the eleventh plate 311. The stanchion 104 inserts through the twelfth nut 324 of the twelfth plate 321 such that the inferior face of the twelfth plate 321 rests on the superior end of the eleventh spacer 411.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bolt: As used in this disclosure, a bolt is a cylindrical shaft that is formed with an exterior screw thread. A bolt is defined with an outer diameter.

Cavity: As used in this disclosure, a cavity is an empty space or negative space that is formed within an object. See Saucer Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Extension Structure: As used in this disclosure, an extension structure is an inert physical structure that is used to extend or bridge the reach between any two objects.

Exterior Screw Thread: An exterior screw thread is a ridge wrapped around the outer surface of a tube in the form of a helical structure that is used to convert rotational movement into linear movement.

Figurine: As used in this disclosure, a figurine is a three-dimensional structure resembling a human, animal or symbolic image.

Foodstuff: As used in this disclosure, a foodstuff refers to an edible material that is used as food or a beverage.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia or of the appearance of something or someone.

Indicia: As used in this disclosure, the term indicia refers to a set of markings that identify a sentiment.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Nut: As used in this disclosure, a nut is a prism-shaped disk that is formed with a cylindrical negative space that allows a shaft to be inserted through the faces of the disk. A nut is further defined with an inner diameter. The nut may or may not be formed with an interior screw thread.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan. A semi-enclosed pan refers to a pan wherein an end of prism structure of the pan and a portion of the lateral face of the pan is also open.

Pedestal: As used in this disclosure, a pedestal is an intermediary load bearing structure that that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectangular Block: As used in this disclosure, a rectangular block refers to a three-dimensional structure comprising six rectangular surfaces (commonly called faces) formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Screw: As used in this disclosure, to screw is a verb meaning: 1) to fasten or unfasten (unscrew) a threaded connection; or 2) to attach a helical structure to a solid structure.

Sentiment: As used in this disclosure, a sentiment refers to a symbolic meaning or message that is communicated through the use of an image, potentially including a text based image.

Spacer: As used in this disclosure, a spacer is a prism-shaped disk that is formed with a cylindrical negative space that allows a shaft to be inserted through the faces of the disk structure of the spacer. A spacer is further defined with an inner diameter. A spacer is often referred to as a washer.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A holiday candy tree comprising a stanchion;

a plurality of plates vertically spaced apart from each other along the stanchion, wherein each of the plates is a rectangular block that comprises a top surface and at least one cavity formed in the top surface respectively, wherein each cavity is configured to store a food item therein;

a plurality of spacers, wherein a respective spacer is between each adjacent pair of plates from the plurality of plates to keep the plates spaced apart from each other by an interval;

a generally rectangular pedestal configured to rest directly upon a support surface to support the holiday candy tree upon the support surface;

wherein a corresponding lowermost plate from the plurality of plates further comprises bottom surface and a cutout section formed in the bottom surface;

wherein substantially the entire pedestal is nested within the cutout section;

wherein the plates and the pedestal are generally coplanar;

wherein the stanchion interconnects the plurality of plates, the plurality of spacers, and the pedestal; wherein the holiday candy tree is a figurine of a Christmas tree.

2. The holiday candy tree according to claim 1 wherein each plate is horizontally oriented.

3. The holiday candy tree according to claim 2 wherein the spacers are identical;

wherein each of the plurality of spacers has a cylindrical shape;

wherein each of the spacers comprises a hole therethrough defining an inner diameter that is greater than a diameter of the stanchion such that the stanchion is configured to be inserted through the plurality of spacers.

4. The holiday candy tree according to claim 3 wherein the pedestal is horizontally oriented.

5. The holiday candy tree according to claim 4 wherein the stanchion is a vertically oriented shaft;

wherein the stanchion stabilizes the holiday candy tree.

6. The holiday candy tree according to claim 5 wherein the plurality of plates comprises a first plate, a second plate, a third plate, a fourth plate, a fifth plate, a sixth plate, a seventh plate, an eighth plate, a ninth plate, a tenth plate, an eleventh plate and a twelfth plate;

wherein the first plate is between the pedestal and the second plate;

wherein the second plate is between the first plate and the third plate;

wherein the third plate is between the second plate and the fourth plate;

wherein the fourth plate is between the third plate and the fifth plate;

wherein the fifth plate is between the fourth plate and the sixth plate;

wherein the sixth plate is between the fifth plate and the seventh plate;

wherein the seventh plate is between the sixth plate and the eighth plate;

wherein the eighth plate is between the seventh plate and the ninth plate;

wherein the ninth plate is between the eighth plate and the tenth plate;

wherein the tenth plate is between the ninth plate and the eleventh plate;

wherein the eleventh plate is between the tenth plate and the twelfth plate;

wherein the twelfth plate is above the eleventh plate.

7. The holiday candy tree according to claim 6 the plurality of spacers comprises a first spacer, a second spacer, a third spacer, a fourth spacer, a fifth spacer, a sixth spacer, a seventh spacer, an eighth spacer, a ninth spacer, a tenth spacer, and an eleventh spacer;

wherein the first spacer separates the first plate and the second plate;

wherein the second spacer separates the second plate and the third plate;

wherein the third spacer separates the third plate and the fourth plate;

wherein the fourth spacer separates the fourth plate and the fifth plate;

wherein the fifth spacer separates the fifth plate and the sixth plate;

wherein the sixth spacer separates the sixth plate and the seventh plate;

wherein the seventh spacer separates the seventh plate and the eighth plate;

wherein the eighth spacer separates the eighth plate and the ninth plate;

wherein the ninth spacer separates the ninth plate and the tenth plate;

wherein the tenth spacer separates the tenth plate and the eleventh plate;

wherein the eleventh spacer separates the eleventh plate and the twelfth plate.

8. The holiday candy tree according to claim 7, wherein the first plate has a first length;

wherein the second plate has a second length;

wherein the third plate has a third length;

wherein the fourth plate has a fourth length;

wherein the fifth plate has a fifth length;

wherein the sixth plate has a sixth length;

wherein the seventh plate has a seventh length;

wherein the eighth plate has an eighth length;

wherein the ninth plate has a ninth length;

wherein the tenth plate has a tenth length;

wherein the eleventh plate has an eleventh length;

wherein the twelfth plate has a twelfth length;

wherein the first length, the second length, the third length, and the fourth length are approximate equal;

wherein the fifth length is less than the fourth length;

wherein the sixth length is less than the fifth length;

wherein the seventh length is less than the sixth length;

wherein the eighth length is less than the seventh length;

wherein the ninth length is less than the eighth length;

wherein the tenth length is less than the ninth length;

wherein the eleventh length is less than the tenth length;

and wherein the twelfth length is less than the eleventh length.

* * * * *